US011607028B2

(12) United States Patent
Hoffmann

(10) Patent No.: US 11,607,028 B2
(45) Date of Patent: Mar. 21, 2023

(54) BABY ACCESSORY UTILITY BAG

(71) Applicant: Tania Hoffmann, Vero Beach, FL (US)

(72) Inventor: Tania Hoffmann, Vero Beach, FL (US)

( * ) Notice: Subject to any disclaimer, the term of this patent is extended or adjusted under 35 U.S.C. 154(b) by 0 days.

(21) Appl. No.: 17/739,086

(22) Filed: May 7, 2022

(65) Prior Publication Data

US 2022/0256998 A1 Aug. 18, 2022

(51) Int. Cl.
*A45F 3/02* (2006.01)
*A47D 5/00* (2006.01)
*A45F 3/00* (2006.01)

(52) U.S. Cl.
CPC ..... *A45F 3/02* (2013.01); *A47D 5/006* (2013.01); *A45F 2003/003* (2013.01)

(58) Field of Classification Search
CPC ..... A45F 3/02; A47D 5/006
USPC ..... D3/287, 215, 216, 232, 226, 233; 224/607, 614–622, 572
See application file for complete search history.

(56) References Cited

U.S. PATENT DOCUMENTS 2,767,895 A * 10/1956 Smith ..... B60R 7/043 224/563
3,143,748 A * 8/1964 Manning ..... A47G 9/1045 383/4
4,154,323 A * 5/1979 Sneider ..... A47D 15/003 383/4
4,164,968 A * 8/1979 Esposito, Jr. ..... A63B 60/58 224/607
4,186,859 A 2/1980 Frankfort
D265,447 S * 7/1982 Harris ..... D6/553
4,566,130 A * 1/1986 Coates ..... A45C 9/00 190/117
4,585,127 A * 4/1986 Benedict ..... A47B 61/02 211/94.01
D294,757 S * 3/1988 Kahane ..... D3/273
4,815,764 A 3/1989 Carpenter
4,824,168 A 4/1989 Makoski
4,830,238 A * 5/1989 Widinski ..... B62B 9/26 224/563
4,859,084 A * 8/1989 Kaumeyer ..... A63B 55/00 383/22
D306,520 S * 3/1990 McCarthy ..... D6/513
4,960,204 A * 10/1990 Young ..... A45C 5/00 190/111
D312,349 S * 11/1990 Pogue ..... D12/416
5,038,986 A * 8/1991 Beauchesne ..... B62B 3/1428 224/533
5,326,175 A 7/1994 Carter
5,439,154 A * 8/1995 Delligatti ..... A45F 3/02 224/601

(Continued)

FOREIGN PATENT DOCUMENTS

DE 102015113881 A1 * 2/2017 ..... A45C 13/123

*Primary Examiner* — Justin M Larson
(74) *Attorney, Agent, or Firm* — Bullock Law; Stephen Bullock

(57) ABSTRACT

Embodiments of the present invention are related to a baby accessory utility bag including a front incorporating a plurality of pockets with a plurality of upper pockets, a plurality of medial pockets, and a plurality of lower pockets. The bag has a bag body and a back including a back pocket spanning the length of the bag body. The back includes a removably attached changing pad. The bag also includes a carrying strap structured to fit separately overtop a user's shoulder and a baby stroller handlebar.

20 Claims, 11 Drawing Sheets

(56) References Cited

U.S. PATENT DOCUMENTS

D362,748 S * 10/1995 Schildkraut ..... D3/20
5,649,658 A * 7/1997 Hoffman ..... A47D 5/006 5/655
5,702,038 A 12/1997 Miller
5,704,527 A 1/1998 Struzer
5,819,999 A * 10/1998 Tennant ..... A47C 4/52 224/155
5,868,227 A 2/1999 Garcia
5,878,672 A * 3/1999 Ostermann ..... B60N 3/004 297/188.06
5,941,437 A 8/1999 Okumura
5,961,018 A 10/1999 Abelbeck
D416,677 S * 11/1999 Christman ..... D3/246
6,006,462 A * 12/1999 Lackomar ..... B60R 7/043 40/643
6,390,422 B2 5/2002 Banko
D459,877 S * 7/2002 Laprise ..... D3/254
6,412,676 B1 * 7/2002 Stallings ..... E04H 4/14 224/601
6,763,986 B2 * 7/2004 Santos ..... B60R 7/043 224/586
D498,585 S * 11/2004 Darling ..... D12/416
7,222,705 B1 * 5/2007 Guza ..... A45C 15/00 383/4
D547,946 S * 8/2007 Johnson ..... D3/246
D608,530 S * 1/2010 Williams ..... D2/864
7,748,584 B2 * 7/2010 Easom ..... B25H 3/00 224/563
D656,317 S * 3/2012 Baas ..... D3/303
D669,683 S * 10/2012 Caperon ..... D3/232
8,413,863 B2 * 4/2013 Bergman ..... B62B 9/26 224/614
D689,282 S * 9/2013 Lindeman ..... D3/231
D690,507 S * 10/2013 Hall ..... D3/232
D782,187 S * 3/2017 Lucas ..... D3/232
9,771,183 B1 * 9/2017 Oliver ..... A45C 3/00
D801,043 S * 10/2017 Lucas ..... D3/246
D807,033 S * 1/2018 Lucas ..... D3/246
D828,690 S * 9/2018 Gray ..... D3/289
D855,974 S * 8/2019 Vickery ..... D3/232
D862,071 S * 10/2019 Winters Giesting ..... D3/246
10,492,366 B1 * 12/2019 Knudsen ..... A01D 75/008
10,596,443 B1 3/2020 Pomroy
D882,255 S * 4/2020 Monroe ..... D3/232
10,702,048 B1 * 7/2020 Guterman ..... A45F 3/04
11,034,373 B2 6/2021 Fellema
D926,469 S * 8/2021 Barlier ..... D3/246
2006/0088231 A1 4/2006 Figlietti
2008/0142557 A1 * 6/2008 Hess ..... A45F 3/02 190/18 R
2011/0314608 A1 * 12/2011 Rovin ..... A47D 5/006 5/655
2013/0233901 A1 * 9/2013 Robinson ..... A45C 9/00 224/579

* cited by examiner

BABY ACCESSORY UTILITY BAG

FIELD OF THE INVENTION

The present invention relates to systems and methods for carrying baby accessory items. In particular, the present invention relates to a baby accessory utility bag and associated methods.

BACKGROUND

Babies require a lot of specialized attention. As such, there are a lot of accessory items that assist new mothers with caring for their babies. A mother's attention should be focused on tending to the baby's needs rather than finding and transporting baby accessory items.

New mothers have always stressed when traveling with their babies. Organizing the baby accessories along with insuring the items are included adds to that stress. Juggling those items in several bags and trying to utilize the undercarriage of a stroller compounds the issue.

There exists a need in the art for a carrying bag that easily fits overtop a stroller handlebar. The bag should also be easily removable and transportable over the shoulder. Furthermore, there exists a need in the art for a bag that easily organizes a mother's baby accessory items with the aforethought of a seasoned mother that has shared the struggle. Therefore, there exists a need in the art for a baby accessory utility bag and associated methods.

SUMMARY OF THE INVENTION

Embodiments of the present invention are related to a baby accessory utility bag with a front incorporating a plurality of pockets including a plurality of upper pockets, a plurality of medial pockets, and a plurality of lower pockets. The bag may include a bag body and a back with a back pocket spanning the length of the bag body. The bag may also include a carrying strap structured to fit separately overtop a user's shoulder and a baby stroller handle. In some embodiments, the plurality of upper pockets may be zippered pockets, while the plurality of medial pockets and the plurality of lower pockets may be pouches. In some embodiments, the carrying strap length may be structured to be adjustable and the back pocket may be a zippered pocket. Furthermore, at least one of the pockets of the plurality of upper pockets may include at least one of a transparent viewing window and an access cutout. Additionally, in some embodiments, the back may include a removably attached changing pad that may be removably attached via at least one of hook and loop fasteners and snaps.

In some embodiments, the removably attached changing pad is made of water-resistant material such as leather or vinyl. Furthermore, the back may include a fixed attachment tab structured to removably attach to a second attachment tab that is fixedly attached to the changing pad. Similarly, the changing pad may include a third attachment tab fixedly attached to the changing pad structured to removably attach to the second attachment tab. The changing pad may include a width that is equal or less than the width of the baby accessory utility bag and the changing pad length may be 25% to 50% longer than the back. The changing pad may be foldable longitudinally and may be structured to removably attach to itself when folded. Additionally, in some embodiments, at least one of the pockets of the plurality of upper pockets may include a transparent viewing window and, in some embodiments, the carrying strap length may be adjustable.

Some embodiments may be directed to a baby accessory utility bag incorporating a front with a plurality of pockets including a plurality of upper pockets including zippers structured to open and enclose the upper pockets, a plurality of medial pockets each with a pleated flap structured to create medial pouches, and a plurality of lower pockets each with a flap and elastic flap ridge structured to create lower pouches. It may include a bag body and a back including a back pocket spanning the length of the bag body. The back may also include a removably attached changing pad and the bag may have a carrying strap structured to fit separately overtop a user's shoulder and a baby stroller handle. The plurality of upper pockets may each have a vertical length ranging from 25% to 33% of the vertical front length. The plurality of medial pockets may each have a vertical length ranging from 33% to 40% of the vertical front length. Likewise, the plurality of lower pockets may each have a vertical length ranging from 25% to 33% of the vertical front length. In some embodiments, especially those directed toward double strollers, the baby accessory utility bag may include at least three lower pockets.

DETAILED DESCRIPTION OF THE INVENTION

The present invention will now be described in detail with reference to the accompanying drawings. The embodiment descriptions are illustrative and not intended to be limiting in any way. Other embodiments of the invention will readily suggest themselves to persons with ordinary skill in the art after having the benefit of this disclosure. Accordingly, the following embodiments are set forth without any loss of generality and without imposing limitation upon the claimed invention.

Directional terms such as "above" "below" "upper" "lower" and other like terms are used for the convenience of the reader in reference to the drawings. Additionally, the description may contain terminology to convey position, orientation, and direction without departing from the principles of the present invention. Such positional language should be taken in context of the represented drawings.

Quantitative terms such as "generally" "substantially" "mostly" and other like terms are used to mean that the referred object, characteristic, or quality constitutes a majority of the referenced subject. Likewise, use of the terms such as first and second do not necessarily designate a limitation of quantity. Such terms may be used as a method of describing the presence of at least one of the referenced elements or may provide a means of differentiating orientation. The meaning of any term within this description is dependent upon the context within which it is used, and the meaning may be expressly modified.

Figure 1:
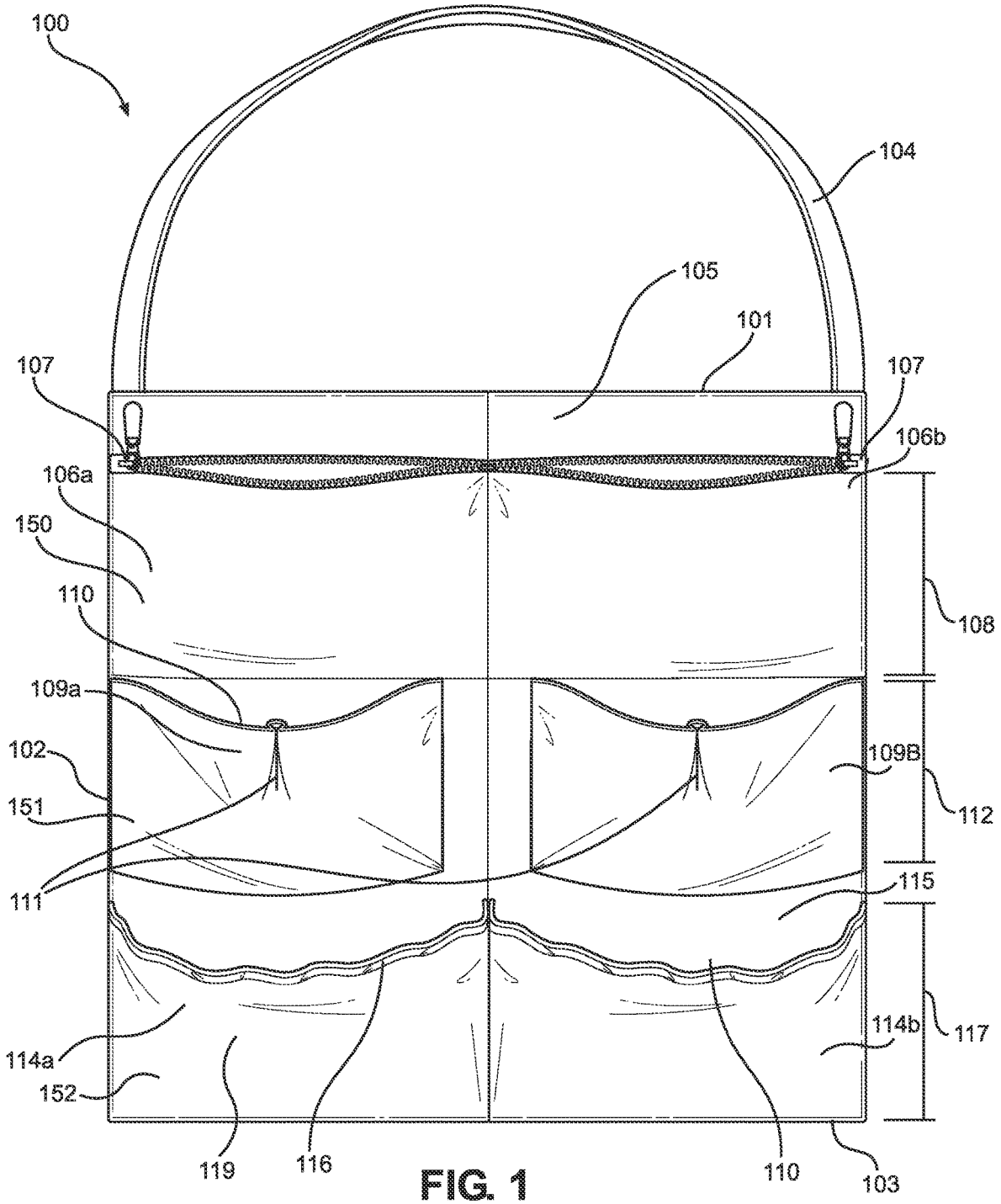
FIG. 1 is a front perspective view of a baby accessory utility bag according to an embodiment of the invention.

Referring now to FIG. 1, the baby accessory utility bag, hereinafter the apparatus 100, is shown. As depicted, the apparatus 100 may include a top 101, a body 102, and a bottom 103. Extending from one side end of the top 101 to another may be a carrying strap 104. As will be described in more detail hereafter, the carrying strap 104 may be sized to fit overtop a baby stroller handlebar and easily removable to fit over the shoulder of an average sized person.

The body 102 may include a front 105 with a plurality of pockets. There may be a plurality of upper pockets 150 including at least a first upper pocket 106*a* and a second upper pocket 106*b*. The plurality of upper pockets 150 may be opened and closed by respective pocket zippers 107. In some embodiments, the plurality of upper pockets 150 may have a vertical length 108 ranging from 25% to 33% of the vertical length of the front 105. As shown, the plurality of upper pockets 150 may include two pockets spanning the width of the front 105. However, one skilled in the art will appreciate that the plurality of upper pockets 150 may include less or more pockets depending on need, preference, and circumstance.

The front 105 may also include a plurality of medial pockets 151 including at least a first medial pocket 109*a* and a second medial pocket 109*b*. The plurality of medial pockets 151 may include pleated flaps 111 to create open pouches 110 as the pockets. In some embodiments, the plurality of medial pockets 151 may have a vertical length 112 ranging from 33% to 40% of the vertical length of the front 105. As shown, the plurality of medial pockets 151 may include two pockets spanning the entire width or a majority of the width of the front 105. However, one skilled in the art will appreciate that the plurality of medial pockets 151 may include less or more pockets depending on need, preference, and circumstance. In particular, in some embodiments intended for double strollers with wider handlebars, the apparatus 100 may include three medial pockets 151 spanning across a wider front 105.

The front 105 may also include a plurality of lower pockets 152 including at least a first lower pocket 114*a* and a second lower pocket 114*b*. The plurality of lower pockets 152 may include elastic flap ridges 116 on lower pocket flaps 119 to create openable pouches 110 as the pockets. In some embodiments, the plurality of lower pockets 152 may have a vertical length 117 ranging from 25% to 33% of the vertical length of the front 105. As shown, the plurality of lower pockets 152 may include two pockets spanning the entire width or a majority of the width of the front 105. However, one skilled in the art will appreciate that the plurality of lower pockets 152 may include less or more pockets depending on need, preference, and circumstance. In particular, in some embodiments intended for double strollers with wider handlebars, the apparatus 100 may include three lower pockets 152 spanning across a wider front 105.

Figure 2:
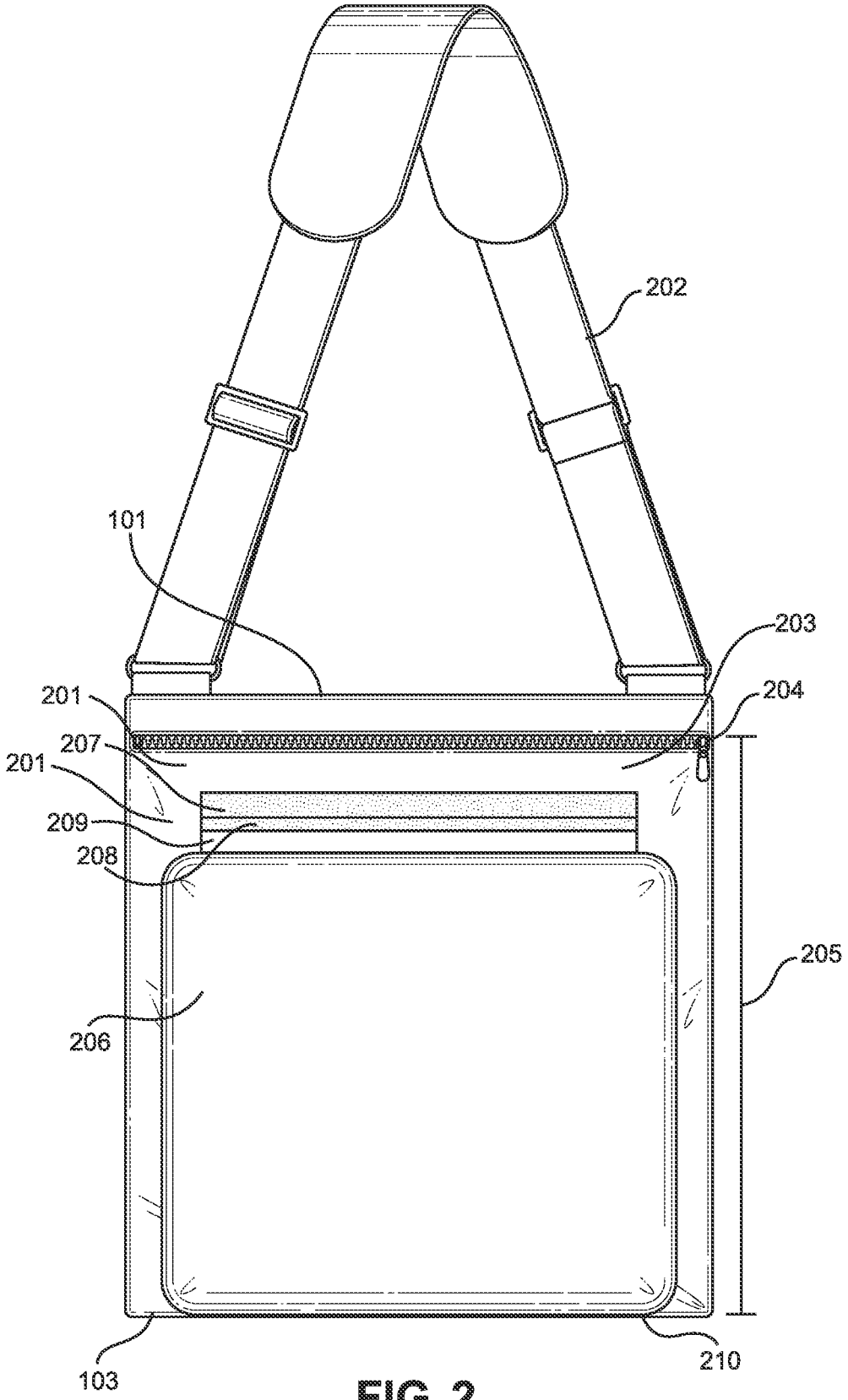
FIG. 2 is a back perspective view of a baby accessory utility bag according to an embodiment of the invention.

FIG. 2 illustrates the apparatus back 201. As shown, in some embodiments the apparatus 100 may include an adjustable strap 202 with shoulder pad 202*a*. This may allow for the apparatus 100 to fit overtop of stroller handlebars of varied width and sizes and may provide more comfort and stability when using it as an over-the-shoulder bag.

The back 201 may also include a back pocket 203 that may span or nearly span the entire longitudinal length of the bag body 102. It may also span or nearly span the entire width of the back 201 extending from one side of the back 201 to the other. Therefore, in some embodiments, the back pocket 203 may encompass the entirety of the back 201. Furthermore, the back pocket 203 may be opened and closed via back pocket zipper 204.

The back 201 may also include a removably attached changing pad 206. In some embodiments, the changing pad 206 may be made from water resistant material such as vinyl, leather, and the like. In some embodiments, the changing pad 206 may be sewn at the edges to create an inner pouch for stuffing, thereby creating an elongate pillow-like pad.

In some embodiments, the changing pad 206 may be removably attached to the back 201 of the apparatus 100 via an attachment tab system. There may be a first attachment tab 207 fixedly attached to the back 201 that may engage with a second attachment tab 208 either on, or extending from a first end of the changing pad 206. Attachment tab 207 may removably engage attachment tab 208 to either attach or remove the changing pad from the apparatus 100. A third attachment tab 209 may be located on, or extend from, a second end of the changing pad 206. The third attachment tab 209 may removably attach to the second attachment tab 208 or in some embodiments, the first attachment tab 207, to create a changing pad medial fold 210 whereby the changing pad is halved and attached to itself for carrying purposes. Therefore, when folded and attached to itself, the bottom of the changing pad 206 may align or come close to aligning with the apparatus bottom 103.

Figure 3:
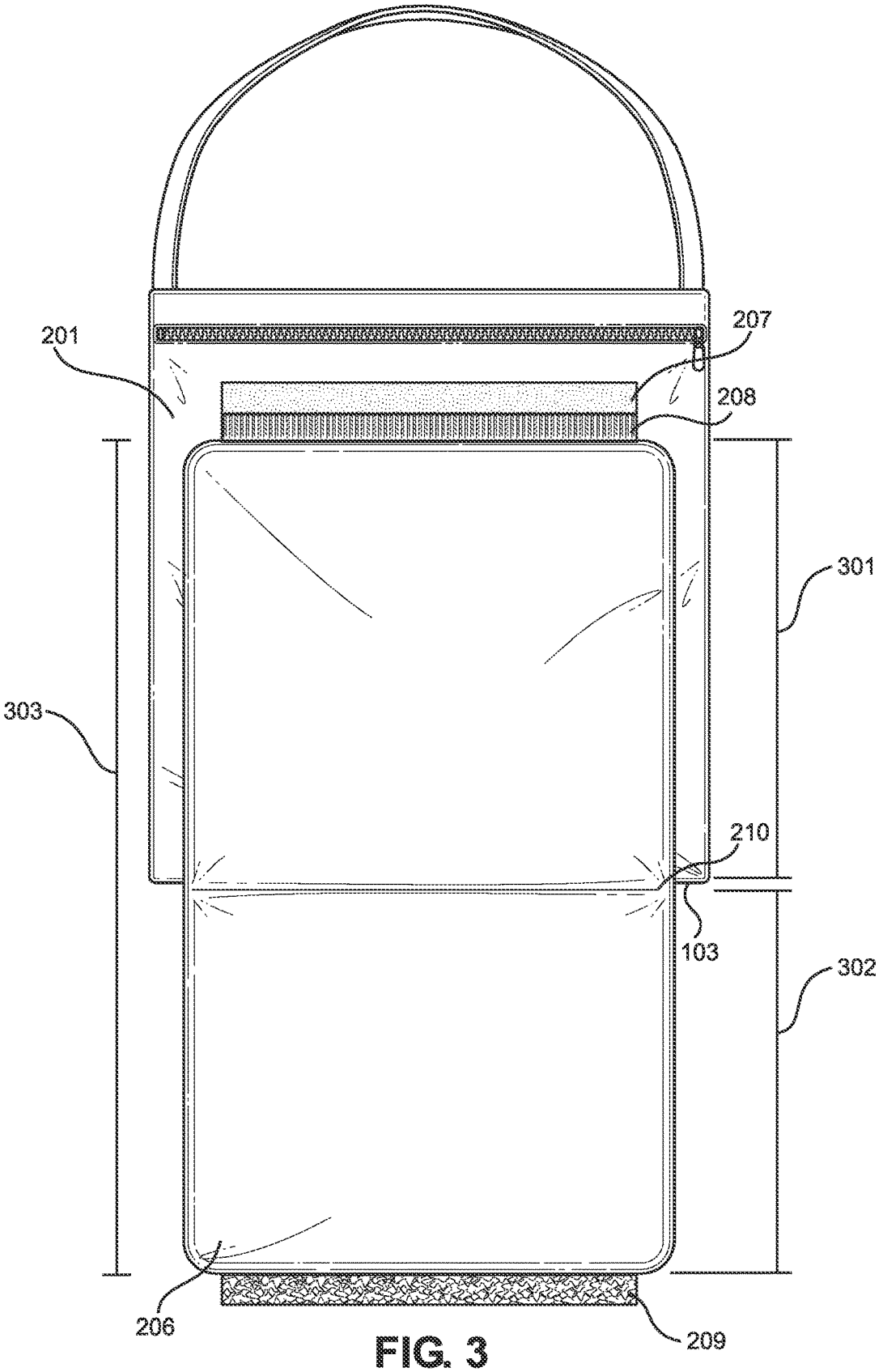
FIG. 3 is a back perspective view of a baby accessory utility bag with changing pad unfolded according to an embodiment of the invention.

FIG. 3 illustrates the back 201 with the changing pad 206 attached to the apparatus 100 whereby the second attachment tab 208 is attached to the first attachment tab 207. In this view, the changing pad 206 is in the unfolded and open position, since the third attachment tab 209 is unattached. With this view, the changing pad length 303 is shown.

In some embodiments, a first half of the changing pad 301 may extend from a position approximately 25% down the face of the back 201 to a position proximate the apparatus bottom 103. Therefore, the medial fold 210 of the changing pad 206 may be positioned proximate the bottom 103. A changing pad second half 302 may extend from a position proximate the bottom 103 to a length approximately equal to the first half of the changing pad 301. In some embodiments, the entire length of the changing pad 206 may be between 25% and 50% longer than the back 201. However, one skilled in the art will appreciate that the changing pad 206 may be larger or smaller depending on need, preference, and circumstance.

Figure 4B:
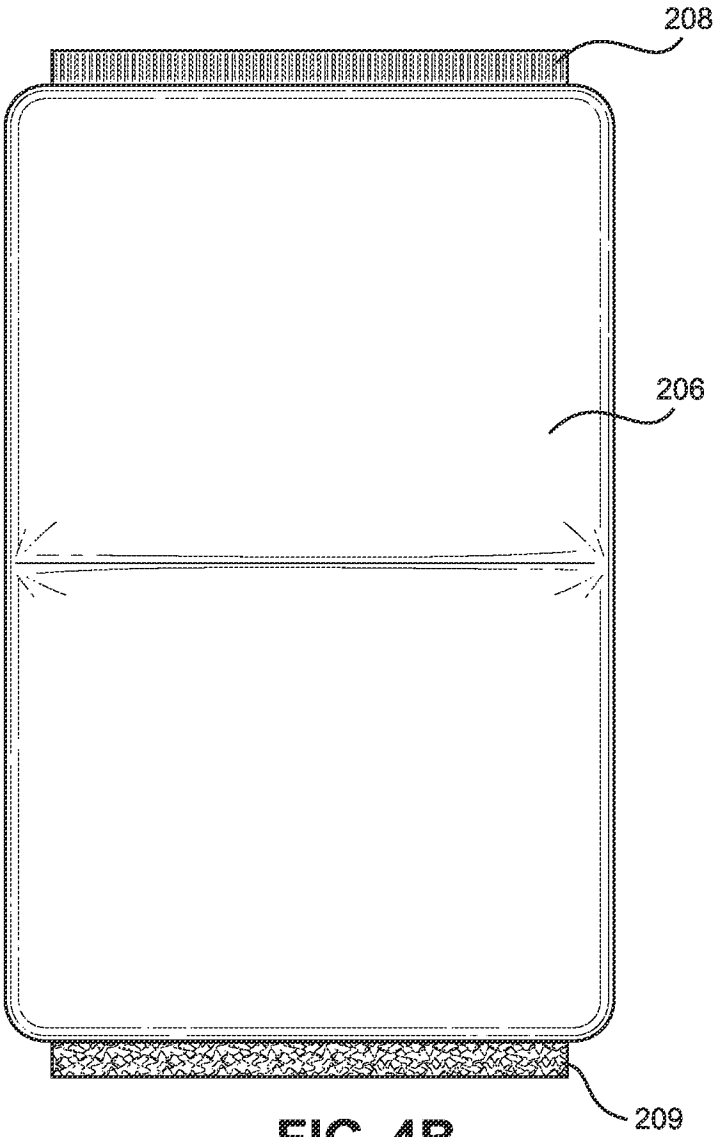
FIG. 4B is front perspective view of a baby accessory utility bag changing pad according to an embodiment of the invention.
Figure 4A:
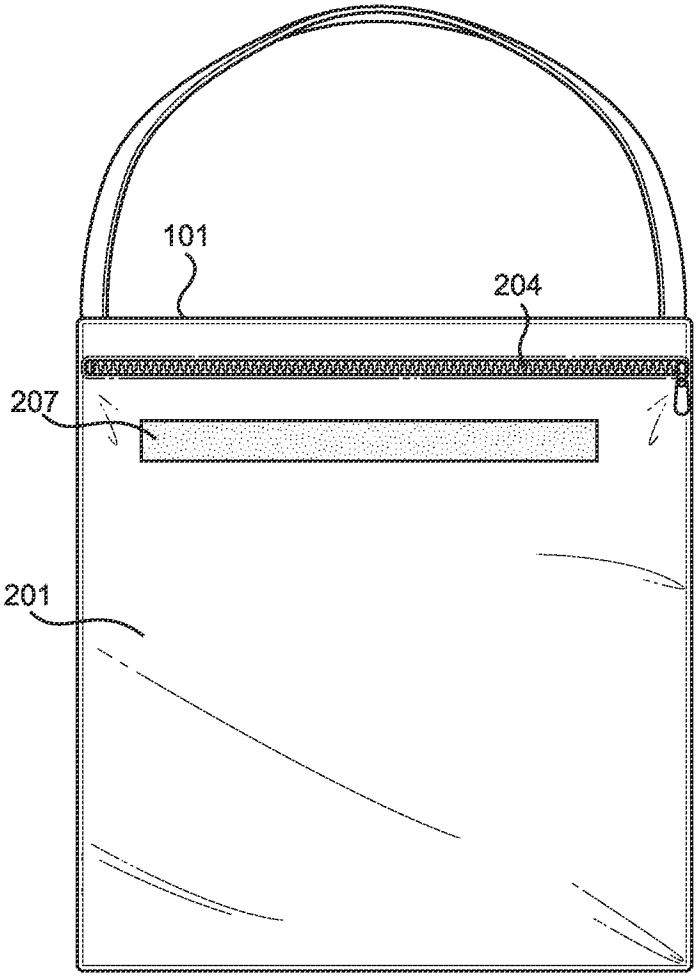
FIG. 4A is a back perspective view of a baby accessory utility bag with changing pad unattached according to an embodiment of the invention.

FIG. 4A highlights the first attachment tab 207 that may be fixedly positioned to the back 201. As shown, the first attachment tab 207 is approximately 15% to 20% down from the apparatus top 101. However, in some embodiments the first attachment tab 207 may be positioned closer to the back zipper 204 and in other embodiments the first attachment tab 207 may be positioned further down the from the top 101.

FIG. 4B highlights the fact that the changing pad 206 may be completely removable from the apparatus 100. This may assist with cleaning the changing pad 206. It may also assist with laying the changing pad 206 flat if the bag is filled with items that may prevent the apparatus 100 from otherwise lying flat. Further highlighted is the fact that in some embodiments, the second attachment tab 208 may extend from a first end of the changing pad 206 and the third attachment tab 209 may extend from a second end of the changing pad 206. However, as previously mentioned, in some embodiments the attachment tabs may be fixedly attached to the body of the changing pad 206.

Figure 5A:
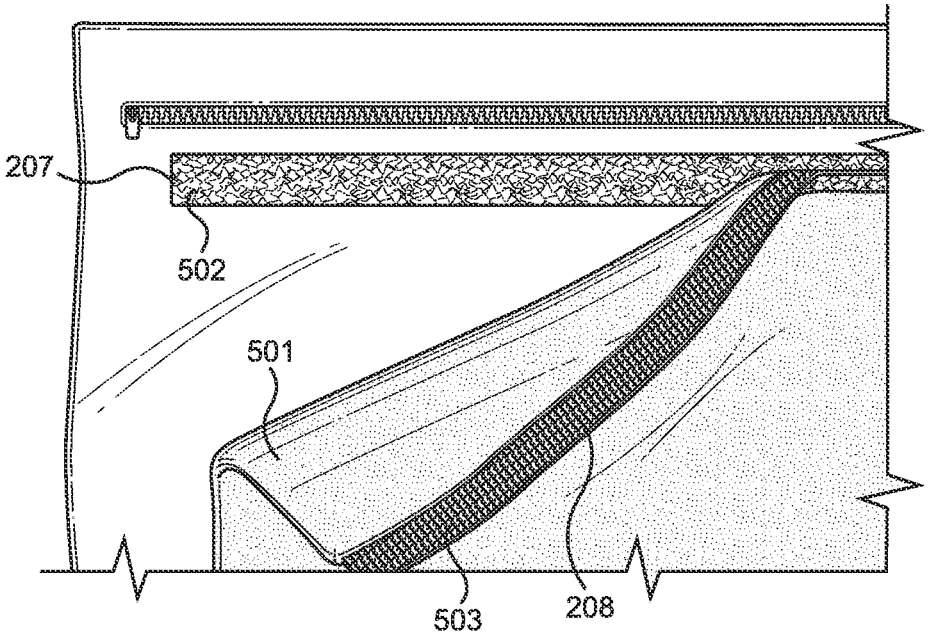
FIG. 5A is a segmented back perspective view of a baby accessory utility bag changing pad attachment feature according to an embodiment of the invention.
Figure 5B:
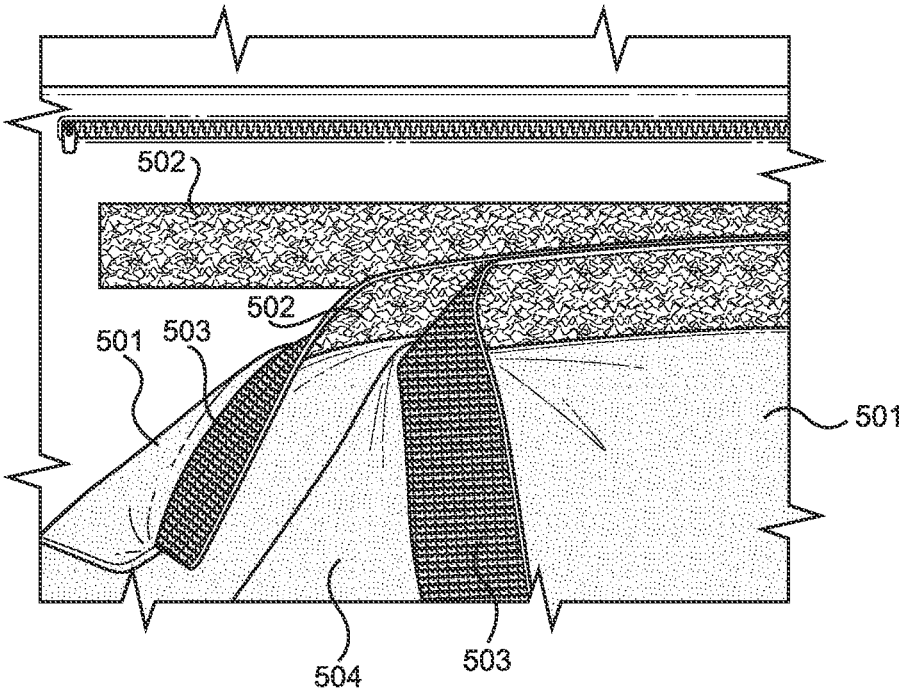
FIG. 5B is a segmented back perspective view of a baby accessory utility bag changing pad attachment feature according to an embodiment of the invention.

FIGS. 5A and 5B show a more detailed look of one embodiment of the attachment tabs 207, 208, 209 utilizing hook and loop fasteners. More specifically in FIG. 5A, in one embodiment, the apparatus 100 may include the first attachment tab 207 with loops 502 opposing the back surface of the back 201 and facing the changing pad 206. Furthermore, the second attachment tab 208 may include one side with hooks 503 positioned to adjoin with the loops 502 of the first attachment tab 207.

FIG. 5B shows that the opposing side of the second attachment tab 208 may include loops 502 structured to adjoin with either the loops 502 of the first attachment tab 207 or the loops of the second attachment tab 208 enabling the changing pad 206 to fold in on itself along the medial fold 210 while attached to the back 201. Therefore, the changing pad underside 501 may abut the back 201 as well as comprise the outermost surface of the apparatus 100 when attached and folded. The main surface 504 of the changing pad 206 may be structured to be folded in on itself. Furthermore, one skilled in the art will appreciate that the hook and loop fastening system may be reversed whereby the hooks 503 are replaced with loops 502 and vice versa.

Figure 5C:
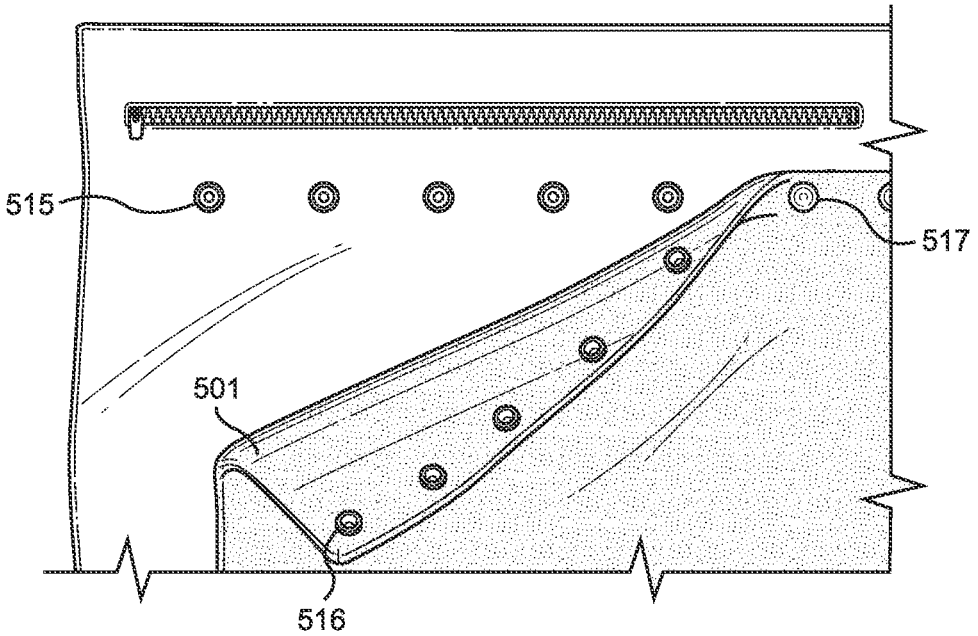
FIG. 5C is a segmented back perspective view of a baby accessory utility bag changing pad attachment feature according to another embodiment of the invention.

FIG. 5C illustrates an embodiment of the invention whereby the attachment tabs 207, 208, 209 are replaced with snaps 515, 516, 517. As shown, the back 201 may be lined with a plurality of bag snaps 515 structured to removably engage a plurality of underside snaps 516 positioned on the underside 501 of one end of the changing pad 206. Furthermore, inside snaps 517 may be positioned at the first and second ends of the inside of the changing pad 206 so that the changing pad may be folded in half and removably engaged with itself.

Figure 5D:
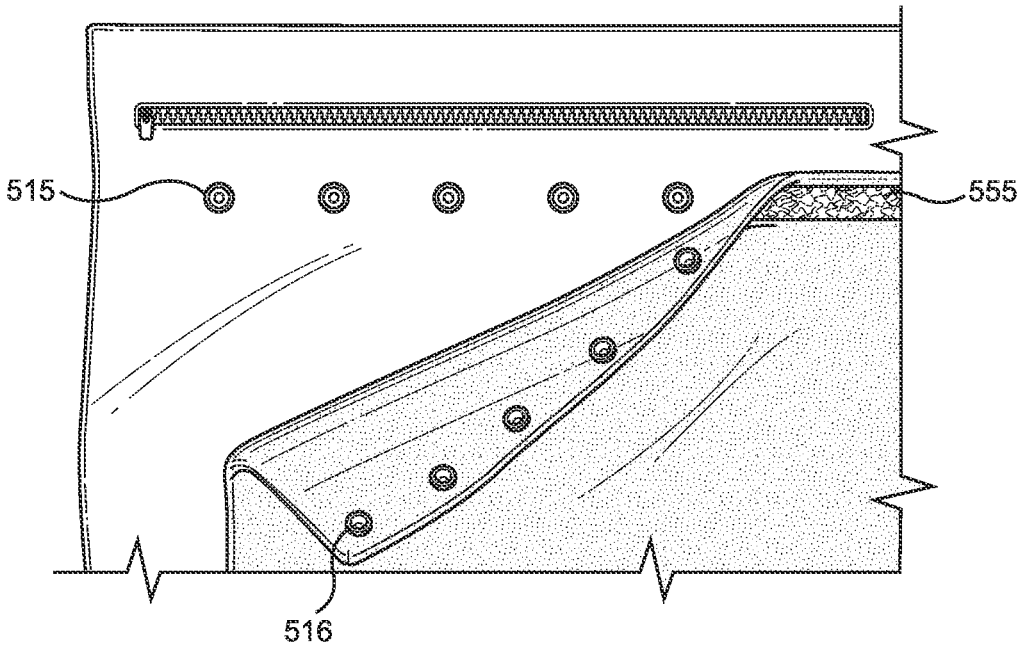
FIG. 5D is a segmented back perspective view of a baby accessory utility bag changing pad attachment feature according to another embodiment of the invention.

FIG. 5D shows that in some embodiments, a combination of snaps as well as hook and loop fasteners may be used. As shown, there may be bag snaps 515 positioned on the back 201 and underside snaps 516 on one side of the changing pad 206. The opposing side of the changing pad 206 at its first and second ends may include hook and loop fasteners 555 to fold in half and removably attach the changing pad 206 for transportation purposes. However, one skilled in the art will appreciate that any combination of snaps 515, 516, 517, hooks and loops 502, 503 and attachment tabs 207, 208, 209 may be used to effectuate the purpose of removably attaching the changing pad 206 to the apparatus 100 and removably attaching the changing pad 206 to itself.

Figure 6A:
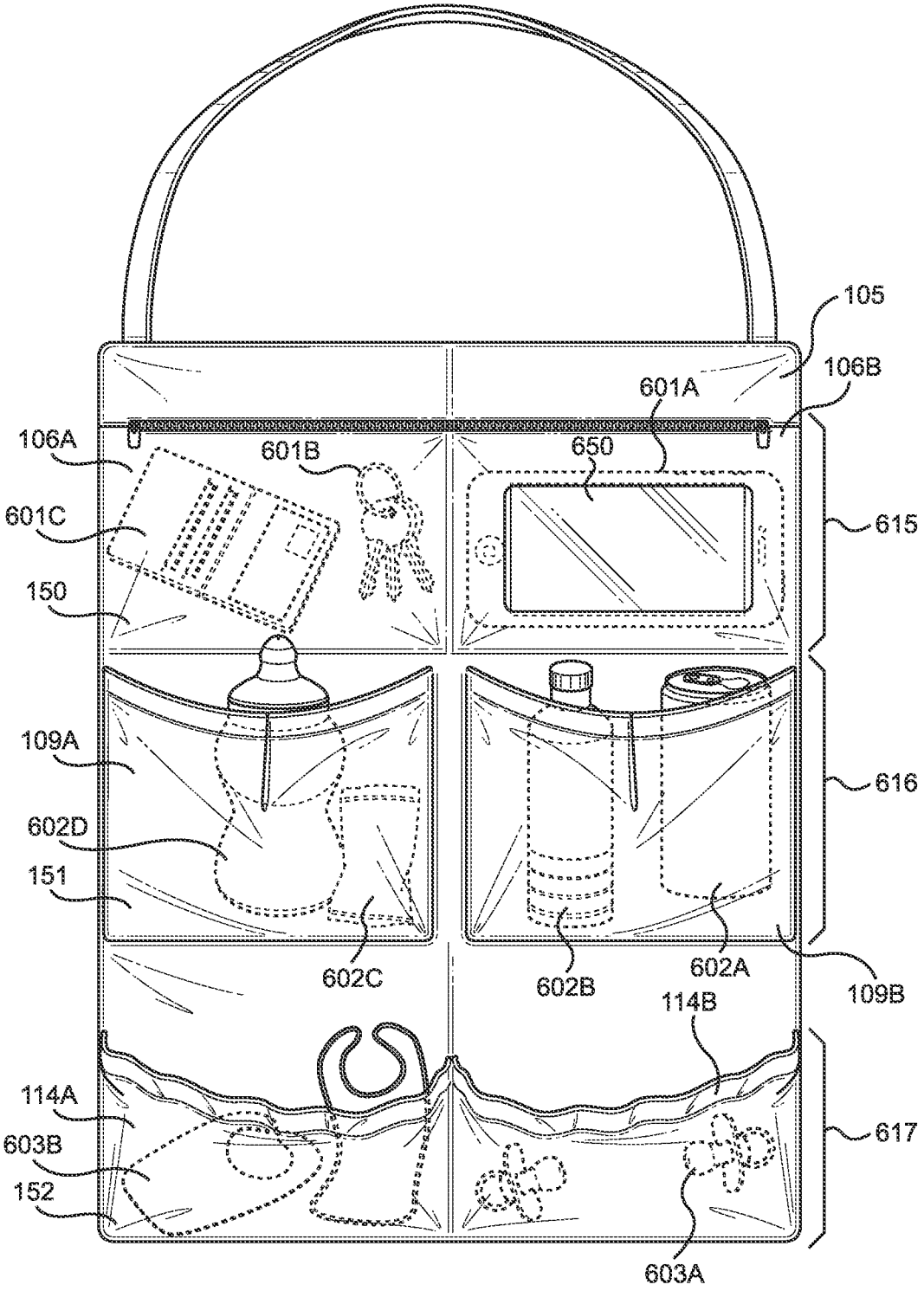
FIG. 6A is a front perspective view of a baby accessory utility bag with example accessories according to an embodiment of the invention.
Figure 6B:
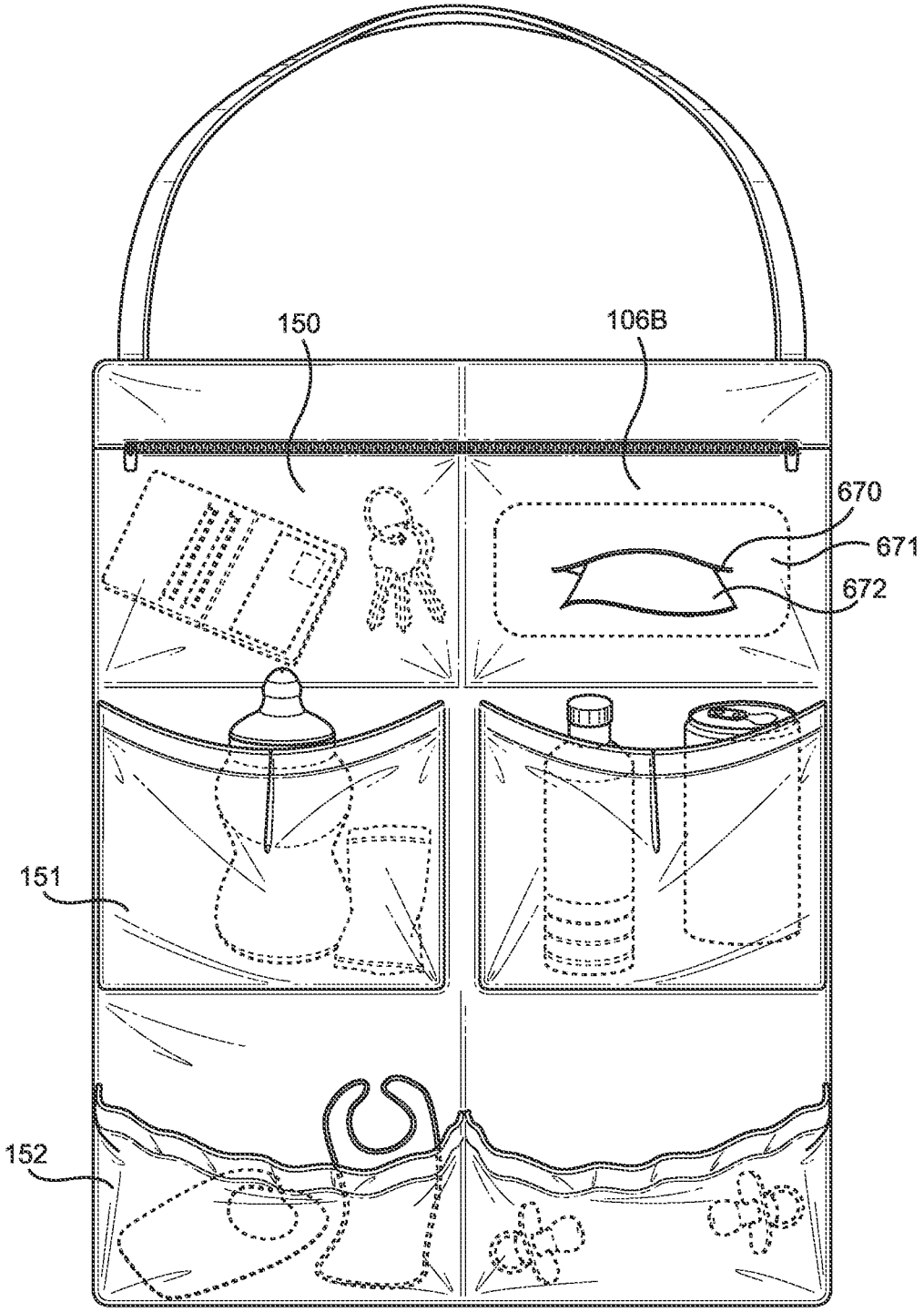
FIG. 6B is a front perspective view of a baby accessory utility bag with example accessories according to another embodiment of the invention

FIGS. 6A and 6B illustrate the type of accessory items that may be transported by the apparatus 100. As shown, the plurality of upper pockets 150 may store personal items 615 such as a cell phone or baby monitor 601*a*, keys 601*b*, and a wallet 601*c*. These items may be stored in the plurality of upper pockets 150 because of the distinct shape and dimensions of the pockets as well as the ability for them to be zippered shut. In some embodiments, at least one of the pockets of the plurality of upper pockets 150 may include a transparent viewing window 650 designed to allow viewing a baby monitor or cellphone 601*a* through the pocket without having to unzip and remove the item. The transparent viewing window 650 may be a square, rectangular, circular, or polygonal clear section of the pocket made from a transparent material such as plastic.

However, FIG. 6B illustrates that in some embodiments the viewing window 650 may be replaced with an uncovered access hole 670 structured as a means for distributing baby wipes, tissues, and the like 672. In other words, at least one pocket of the plurality of upper 150 pockets may include an access cutout 670 sized to accommodate the opening of a standard baby wipes or tissue container 671 whereby the tissues or wipes 672 may be passed through the access cutout opening 670 of the pocket 106*b*. Therefore, a user would not need to open the pocket 106*b*, then open the baby wipe container 671, and subsequently withdraw a baby wipe 672. The access cutout 670 allows for a user to keep open a package of baby wipes, tissues, etc. 671, with the baby wipe, tissue, etc. 672 pre-pulled therethrough. This provides easy access and obviates the need for a user to go through several steps when a baby wipe or tissue 672 is quickly needed.

FIGS. 6A and 6B additionally show items that may be stored in the plurality of medial pockets 151 such as canned food, drinks, and sippy cups 602*a*, water bottles 602*b*, snacks 602*c* and baby bottles 602*d*. These items may be ideal for storage in the plurality of medial pockets 151 because of the distinct shape and dimensions of the pockets including the ease by which items may be placed into and retrieved from the pockets. Furthermore, in some embodiments, a portion of the pleated flap 111 may serve as tabbed divider for different bottles sharing the same pocket.

Items that may be stored in the plurality of bottom pockets 152 may include pacifiers 603*a* and bibs 603*b*. These items may be ideal for storage in the plurality of lower pockets 152 because of the distinct shape and dimensions of the pockets including the ease by which items may be placed into and retrieved from the pockets. The elastic flap ridge 116 may help secure items within the pocket, but also may provide an easy means to open the flap and place items within the pockets.

Figure 7:
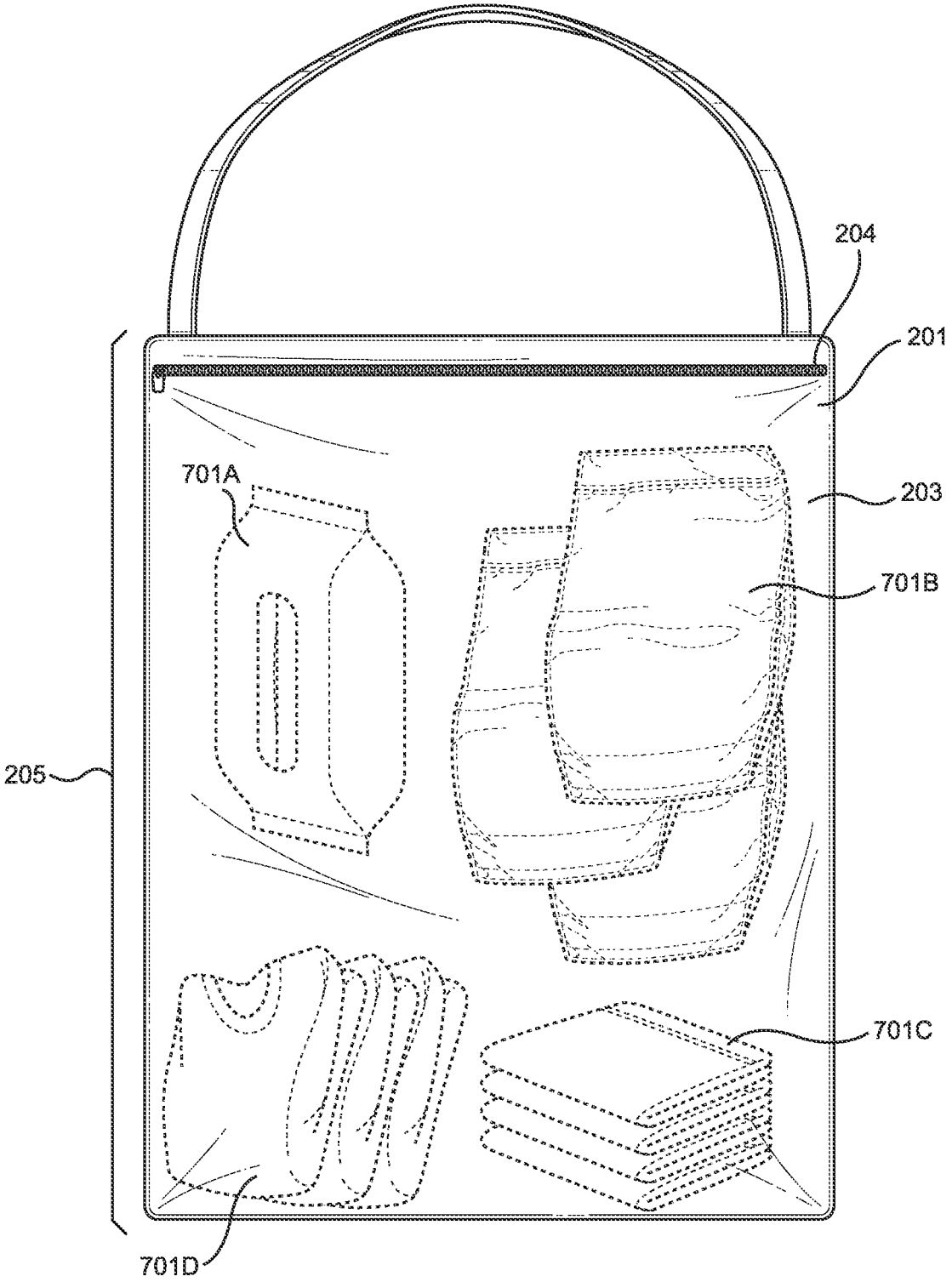
FIG. 7 is a back perspective view of a baby accessory utility bag with example accessories according to an embodiment of the invention.

FIG. 7 illustrates items that may be stored in the back pocket 203. Because the back pocket 203 includes a back pocket length 205 that may be considerably larger than the other pockets, larger items such as baby wipes 701*a*, diapers 701*b*, towels 701*c*, and baby clothes 701*d* may be ideal for storage there.

Figure 8:
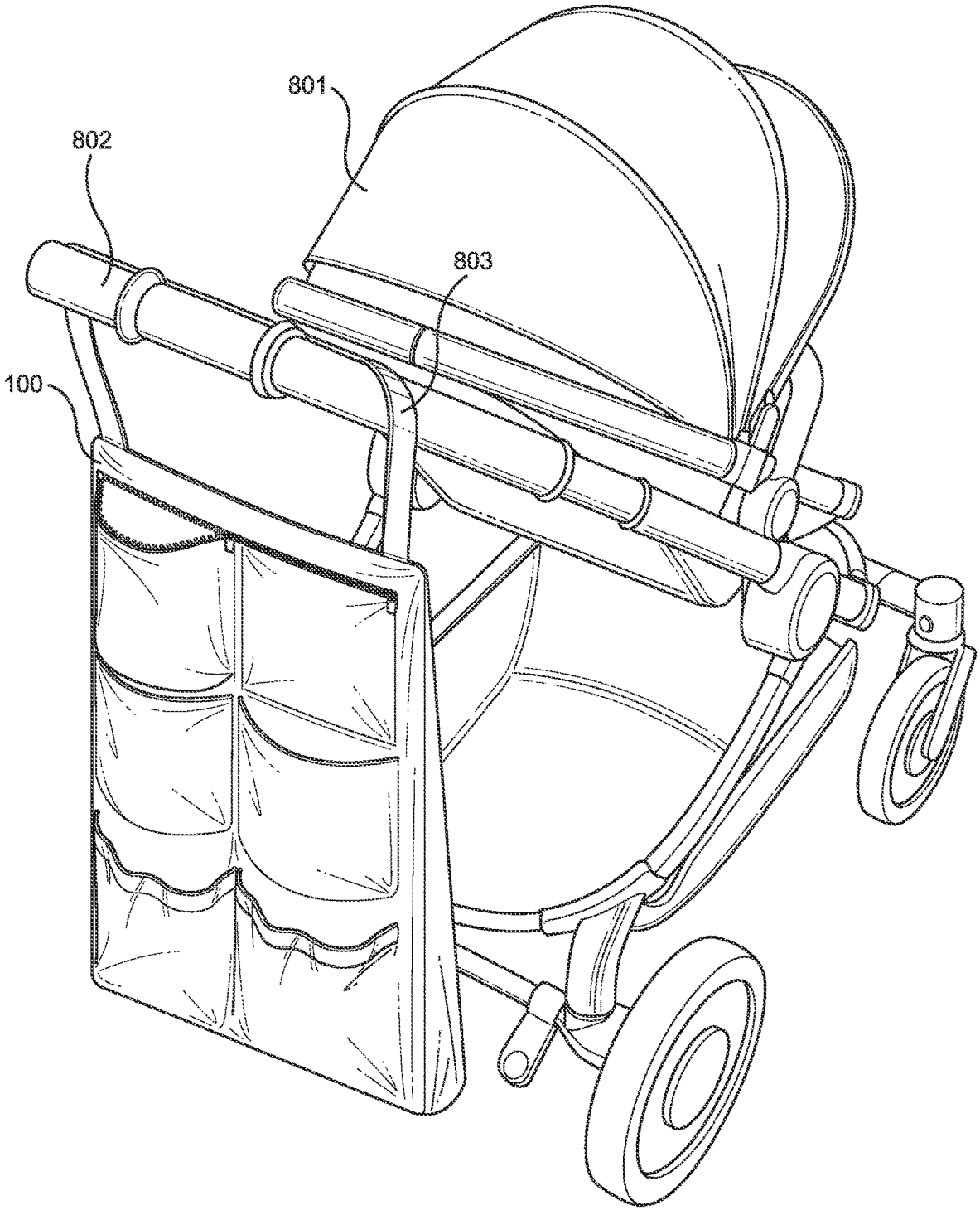
FIG. 8. is a perspective environmental view of a baby accessory utility bag according to an embodiment of the invention.
Figure 9:
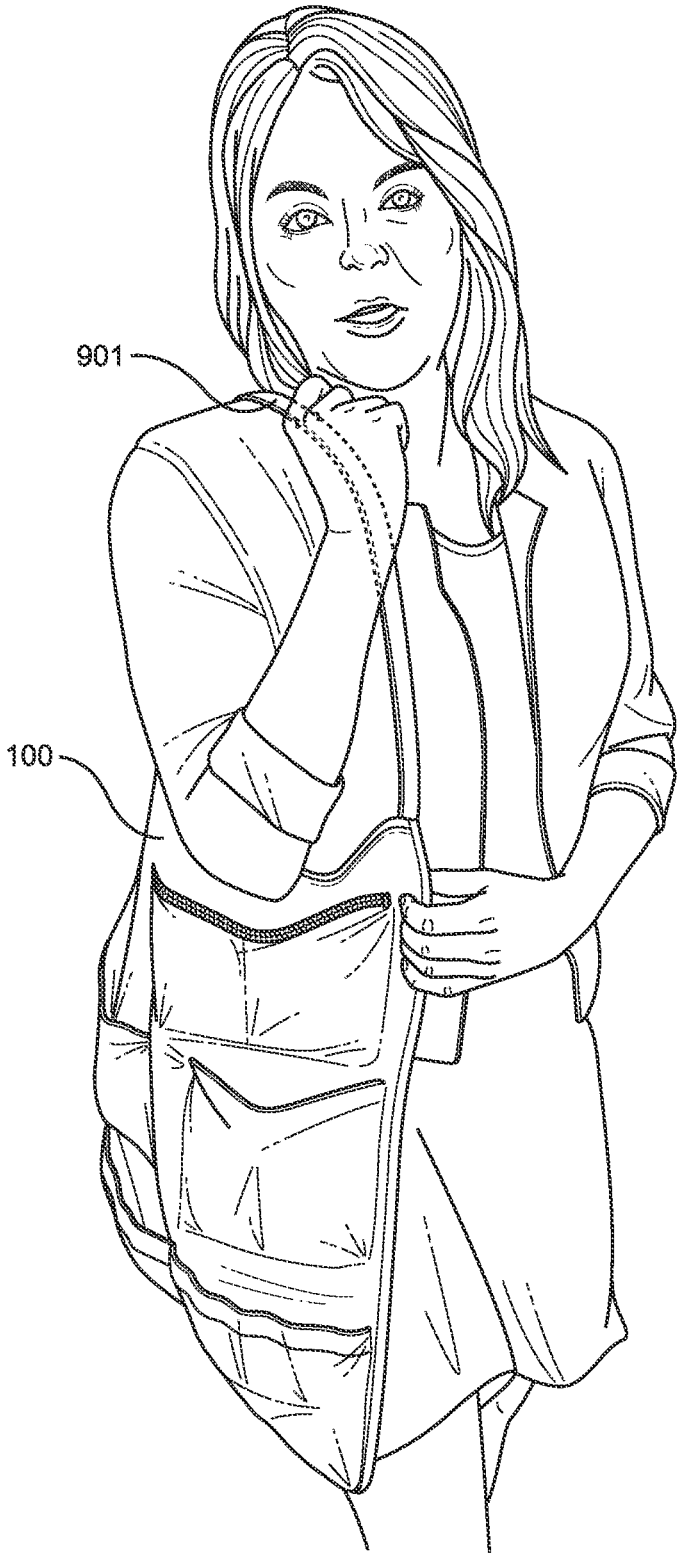
FIG. 9 is a perspective environmental view of a baby accessory utility bag according to an embodiment of the invention.

FIGS. 8 and 9 are environmental views of the apparatus 100 showing that the carrying strap 104 is sized to fit overtop a stroller handlebar 803, while easily removable and transportable over the shoulder of an average sized person 901. Hence, the length of the apparatus 100 and coordinated length of the carrying strap 104 are specifically dimensioned to accommodate the apparatus 100 as both a carrying bag for over the shoulder transport as well as a handsfree hanging bag designed for strollers 801. Therefore, by way of non-limiting example the bag body 102 may be between 15 and 18 inches in length and may be between 17 and 22 inches in width. Likewise, the carrying strap 104 may be between 20 and 30 inches in length. However, one skilled in the art will appreciate that the dimensions of the bag body 102 and carrying strap 104 may vary depending on need, preference, and circumstance.

That which is claimed is:

1. A baby accessory utility bag comprising
a front comprising a plurality of pockets including
a plurality of upper pockets,
a plurality of medial pockets, and
a plurality of lower pockets;
a bag body;
a back comprising
a back pocket spanning the length of the bag body; and
a removable changing pad; and
a carrying strap configured to fit separately overtop a users shoulder and a baby stroller handle;
wherein the changing pad includes first and second ends removably attached to an exterior of the back beneath an opening of the back pocket.

2. The baby accessory utility bag of claim 1 wherein the plurality of upper pockets are zippered pockets.

3. The baby accessory utility bag of claim 1 wherein the plurality of medial pockets and the plurality of lower pockets are open pouches without fasteners.

4. The baby accessory utility bag of claim 1 wherein the carrying strap length is configured to be adjustable.

5. The baby accessory utility bag of claim 1 wherein the back pocket is a zippered pocket.

6. The baby accessory utility bag of claim 1 wherein at least one of the pockets of the plurality of upper pockets comprises at least one of a transparent viewing window and an access cutout.

7. The baby accessory utility bag of claim 1 wherein the back comprises a removably attached changing pad.

8. The baby accessory utility bag of claim 7 wherein the removably attached changing pad is removably attached via at least one of hook and loop fasteners and snaps.

9. A baby accessory utility bag comprising
a front comprising a plurality of pockets including
a plurality of upper pockets,
a plurality of medial pockets, and
a plurality of lower pockets;
a bag body;
a back comprising
a back pocket spanning the length of the bag body; and
a removable changing pad; and
a carrying strap configured to fit separately overtop a users shoulder and a baby stroller handle;
wherein the changing pad includes first and second ends removably attached to an exterior of the back beneath an opening of the back pocket.

10. The baby accessory utility bag of claim 9 wherein the removably attached changing pad is comprised of water-resistant material.

11. The baby accessory utility bag of claim 9 wherein the back comprises an attachment tab configured to removably attach to a second attachment tab fixedly attached to the changing pad.

12. The baby accessory utility bag of claim 11 wherein the changing pad comprises a third attachment tab fixedly attached to the changing pad configured to removably attach to the second attachment tab.

13. The baby accessory utility bag of claim 9 wherein the changing pad comprises a width equal or less than the width of the baby accessory utility bag; and wherein the changing pad length is 25% to 50% longer than the back.

14. The baby accessory utility bag of claim 9 wherein the removably attached changing pad is removably attached via at least one of hook and loop fasteners and snaps.

15. The baby accessory utility bag of claim 9 wherein the changing pad is foldable longitudinally and configured to removably attach to itself when folded.

16. The baby accessory utility bag of claim 9 wherein at least one of the pockets of the plurality of upper pockets comprises at least one of a transparent viewing window and an access cutout.

17. The baby accessory utility bag of claim 9 wherein the carrying strap length is configured to be adjustable.

18. A baby accessory utility bag comprising
a front comprising a plurality of pockets including
a plurality of upper pockets comprising zippers configured to open and enclose the upper pockets with at least one zippered pocket comprising an access cutout,
a plurality of medial pockets each with a pleated flap configured to create medial pouches, and
a plurality of lower pockets each with a flap and elastic flap ridge configured to create lower pouches;
a bag body;
a back comprising
a back pocket spanning the length of the bag body, and
a removable changing pad; and
a carrying strap configured to fit separately overtop a users shoulder and a baby stroller handle;
wherein the changing pad includes first and second ends removably attached to an exterior of the back beneath an opening of the back pocket;
wherein the plurality of upper pockets each have a vertical length ranging from 25% to 33% of the vertical front length;
wherein the plurality of medial pockets each have a vertical length ranging from 33% to 40% of the vertical front length; and
wherein the plurality of lower pockets each have a vertical length ranging from 25% to 33% of the vertical front length.

19. The baby accessory utility bag of claim 18 wherein the plurality of medial pockets and the plurality of lower pockets is at least three pockets.

20. The baby accessory utility bag of claim 18 wherein at least one of the pockets of the plurality of upper pockets comprises a transparent viewing window.

* * * * *